US006364204B1

(12) United States Patent
Thomas

(10) Patent No.: US 6,364,204 B1
(45) Date of Patent: Apr. 2, 2002

(54) COIN CATCHER AND CONTAINER

(76) Inventor: Patsy A. Thomas, 15484 Monte Vista, Detroit, MI (US) 48238

( * ) Notice: Subject to any disclaimer, the term of this patent is extended or adjusted under 35 U.S.C. 154(b) by 0 days.

(21) Appl. No.: 09/421,740

(22) Filed: Oct. 20, 1999

Related U.S. Application Data

(60) Provisional application No. 60/105,254, filed on Oct. 22, 1998.

(51) Int. Cl.[7] ..... B65D 91/00

(52) U.S. Cl. ..... 232/43.5; 232/16; 232/44; 232/55; 232/64; 206/0.81; 220/86.1; 141/337

(58) Field of Search ..... 232/43.1, 43.4, 232/15, 16, 31, 32, 55, 64, 44, 43.5; 206/0.8, 0.81; 141/331, 337, 338; 194/350; 220/86.1

(56) References Cited

U.S. PATENT DOCUMENTS

| | | | | |
|---|---|---|---|---|
| 2,073,914 | A | * | 3/1937 | Wilfley |
| 3,596,813 | A | * | 8/1971 | Munn |
| 3,653,586 | A | * | 4/1972 | Bonneson |
| 3,711,871 | A | | 1/1973 | Sherin |
| 3,781,922 | A | | 1/1974 | Ericson |
| 3,807,627 | A | * | 4/1974 | Nitschneider |
| 3,923,040 | A | | 12/1975 | Beach |
| 3,938,733 | A | | 2/1976 | Weber et al. |
| 4,267,962 | A | | 5/1981 | Domkowski |
| 4,359,184 | A | * | 11/1982 | Sciortino |
| 4,372,479 | A | * | 2/1983 | Sciortino |
| 4,491,212 | A | | 1/1985 | Gray, Jr. |
| 4,559,649 | A | | 12/1985 | Burnett |
| D304,294 | S | | 10/1989 | Grenda |
| 4,921,147 | A | * | 5/1990 | Poirier |
| 4,974,761 | A | | 12/1990 | Luque |
| 5,030,202 | A | * | 7/1991 | Harris |
| 5,044,483 | A | | 9/1991 | Stefan |
| 5,133,481 | A | | 7/1992 | Mayfield |
| 5,158,220 | A | | 10/1992 | Glass |
| 5,458,285 | A | * | 10/1995 | Remien |
| 5,535,793 | A | | 7/1996 | Tantre |
| 5,611,483 | A | * | 3/1997 | Sciortino |
| 5,660,338 | A | * | 8/1997 | Emmerson |
| 5,715,928 | A | | 2/1998 | Bradley |
| 5,850,966 | A | * | 12/1998 | Siler et al. |
| 5,921,296 | A | | 7/1999 | Porter et al. |

* cited by examiner

*Primary Examiner*—B. Dayoan
*Assistant Examiner*—William L. Miller
(74) *Attorney, Agent, or Firm*—Gifford, Krass, Groh, Sprinkle, Anderson & Citkowski, P.C.

(57) ABSTRACT

A receptacle for catching and containing coins being disgorged by a slot machine or similar gaming apparatus is disclosed. The receptacle eliminates the necessity of transferring coins from a disbursement pan into a container. The receptacle includes a bucket having a mouth and a lid having a flexible conduit extending therefrom. The conduit has an inner diameter suitable for the passage of gaming tokens or coinage upon the receptacle being positioned within the disbursement pan of the slot machine. The lid is secured to the bucket. The receptacle is optionally modified to include a handle or a strap to facilitate conveyance thereof.

5 Claims, 1 Drawing Sheet

COIN CATCHER AND CONTAINER

RELATED APPLICATIONS

This application claims the benefit of U.S. Provisional Application Ser. No. 60/105,254, filed Oct. 22, 1998, and is hereby incorporated by reference.

FIELD OF THE INVENTION

The present invention relates to a receptacle for catching and containing coins being disgorged by a slot machine or similar gaming apparatus.

BACKGROUND OF THE INVENTION

A well established feature of a gaming institution is the clatter of coins as they are disbursed from slot machines. A player inserting a coin or coins into a slot machine is rewarded upon a winning pull by the disbursement of coins. The coins drop into a resonant disbursement pan from which the coins are collected. The disbursement pan is designed to resonate the sound of coins dropping therein, so as to add to the atmosphere of the gaming venue.

The design of the disbursement pan in a conventional slot machine does little for the benefit of the player. The noise associated with the coins dropping into the disbursement pan is a distraction to the player who is concentrating on the game. An additional aspect of playing slot machines is the decision when to transfer one's wagering from a given slot machine to another. The process of collecting coins from the disbursement pan of a slot machine following play is both time consuming and awkward. It is common to drop coins from the disbursement pan onto the floor in the process of collecting coins from the disbursement pan. Furthermore, an element of strategy involved in playing slot machines is to allow other players to "prime" a machine by wagering more coins than the machine disburses to them, then beginning play in anticipation of an imminent jackpot. As part of such strategy, it is advantageous to a player to conceal from other players the number of coins a machine has disbursed in the course of play.

The present invention is adapted to insert into various sizes and shapes of slot machine disbursement pans and thereby provide advantages to a player. The present invention catches disbursed coins as they fall from a slot machine and contains the coins therein, in so doing, the clatter of coin disgorgement is muffled, and others are unaware of a player's success at a slot machine.

SUMMARY OF THE INVENTION

The present invention is a receptacle for catching and containing coins being disgorged from a slot machine. The receptacle includes a bucket having a mouth and a lid having a flexible conduit extending therefrom, the conduit having an inner diameter suitable for the passage of gaming tokens or coins when the receptacle is disposed within the disbursement pan of a slot machine. The lid is adapted to selectively seat to the mouth of the bucket such that any coins or tokens passing through the conduit are contained within the bucket. The receptacle is optionally modified to include a handle or a strap attached to either the bucket or the lid. The flexible tube of the receptacle is flexed to accommodate the present invention within a given disbursement pan. Preferably, the flexible conduit terminates in a flared edge which serves to funnel coins into the conduit.

Other advantages of the present invention will be appreciated by reference to the following detailed description when considered in connection with the accompanying drawing wherein:

DETAILED DESCRIPTION OF THE PREFERRED EMBODIMENT(S)

Figure 1:
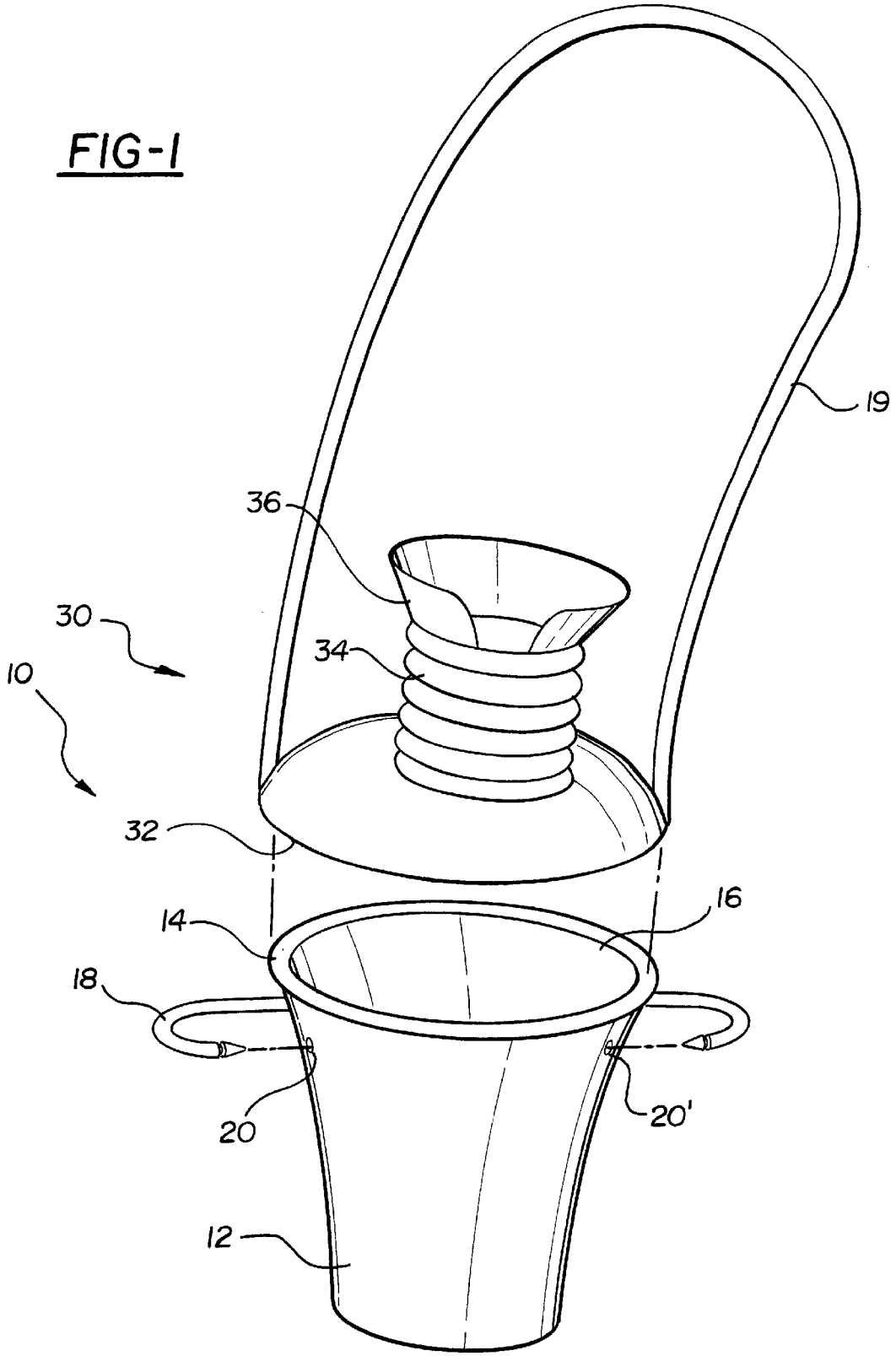
FIG. 1 is a perspective view of a receptacle constructed in accordance with the present invention.

A receptacle for catching a coin disgorged from a slot machine and containing the coin prior to contacting a slot machine disbursement pan is generally shown at 10 in FIG. 1. The receptacle 10 includes a bucket 12. The bucket of the instant invention is designed to hold the coins that are disgorged from a slot machine. A "coin" is defined herein to include tenderable metallic currency of various nations, gaming tokens, slugs, medallions and the like. It is appreciated that the size and shape of a bucket 12 may be varied and yet still be within the scope of the instant invention. Optionally, a bucket having sufficient volume to contain 200 U.S. quarters or 200 half dollar coins or 200 dollar coins is utilized herein. The bucket 12 is constructed from a variety of materials, illustratively including thermoplastics, metal, thermoset resin composites and the like. Preferably, a bucket of the instant invention is constructed from an injectable thermoplastic material, illustratively including polyethylenes, polyvinyl chlorides, polycarbonates and the like.

A bucket 12 optionally has a lip 14 about the open mouth 16. For ease of carrying, a bucket 12 is optionally adapted with a means for attaching a handle thereto. In the embodiment shown in the figure, the means for attaching a handle 18 is a pair of diametric holes 20 and 20' through which the handle inserts and is secured. It is appreciated that a pair of horns may be substituted for 20 and 20' respectively, with the ends of handle 18 being adapted with loops to securely engage the horns.

Another aspect of the present invention includes a strap 19, selectively secured to the bucket 12, the strap adapted to support the receptacle 10 hanging from the neck or shoulder of a gambling patron, the strap illustratively being a woven fabric web, leather, or an elasticized fabric web.

The bucket 12 of a receptacle 10 of the instant invention is selectively secured to a lid 30. The lid 30 has a base 32 adapted to seat against the lip 14 surrounding the bucket opening 16. The base 32 of the lid 30 is slightly larger in dimension than the lip 14 such that the base 32 is selectively press fit about the lip 14. It is appreciated that the rim and lip arrangement shown in the figure is optionally replaced by the other securing fixture illustratively including threads on both the lid and bucket, or the like. The top portion of the lid 30 terminates in a reticulated flexible conduit 34. The reticulations spaced throughout the conduit 34 allows for the receptacle to engage a variety of slot machine types. The conduit 34 is selectively elongated, flexed, or compressed in order to adapt the receptacle 10 to a given slot machine disbursement pan. The free end of the conduit 34 flares to form a coin catcher 36. The coin catcher 36 is optionally notched in order to engage a wider variety of slot machines. Preferably, the lid 30 of the instant invention is constructed from a thermoplastic material.

The invention has been described in a illustrative manner, and it is to be understood that the terminology which has been used is intended to be in the nature of words of description, rather than of limitation. Modifications and variations of the present invention are possible in light of the above teachings. It is therefore to be understood that within the scope of the appended claims the invention may be practiced otherwise than as specifically described.

What is claimed is:

1. A receptacle for catching and collecting coins from a slot machine comprising:

a bucket having a mouth; and a lid having a base, and a flexible conduit extending from the base, said conduit having a coin catcher flaring from an end of said conduit and an inner diameter suitable for the passage of a coin upon said receptacle being disposed within a disbursement pan of the slot machine, wherein the base of said lid is adapted to selectively seat the mouth of said bucket.

2. The receptacle of claim 1 wherein said coin catcher is notched.

3. A receptacle for catching and collecting coins from a slot machine comprising:

a bucket having a mouth; and a lid having a base, and a flexible conduit extending from the base, wherein said flexible conduit is reticulated so that said conduit is selectively elongated and compressed, said conduit having an inner diameter suitable for the passage of a coin upon said receptacle being disposed within a disbursement pan of the slot machine, wherein the base of said lid is adapted to selectively seat the mouth of said bucket.

4. A receptacle for catching and collecting coins from a slot machine comprising:

a bucket having a mouth;

a lid having a base and a reticulated flexible conduit extending from the base, said conduit having an inner diameter suitable for the passage of a coin upon said receptacle being disposed within a disbursement pan of the slot machine, the flexible conduit terminating distal from the base in a flared coin catcher;

and a carving strap affixed to said bucket.

5. A receptacle of claim 4 wherein said bucket is adapted to contain 200 dollar coins.

* * * * *